US009771804B2

(12) United States Patent
Guo et al.

(10) Patent No.: US 9,771,804 B2
(45) Date of Patent: Sep. 26, 2017

(54) FILM COOLING OF TURBINE BLADES OR VANES

(75) Inventors: Liang Guo, University Park (GB); John David Maltson, Skellingthorp (GB); Yuying Yan, Edwalton (GB)

(73) Assignee: Siemens Aktiengesellschaft, Munich (DE)

( * ) Notice: Subject to any disclaimer, the term of this patent is extended or adjusted under 35 U.S.C. 154(b) by 585 days.

(21) Appl. No.: 14/235,060

(22) PCT Filed: Jul. 13, 2012

(86) PCT No.: PCT/EP2012/063804

§ 371 (c)(1),
(2), (4) Date: May 13, 2014

(87) PCT Pub. No.: WO2013/020776

PCT Pub. Date: Feb. 14, 2013

(65) Prior Publication Data

US 2014/0255200 A1 Sep. 11, 2014

(30) Foreign Application Priority Data

Aug. 8, 2011 (EP) ..... 11176850

(51) Int. Cl.
*F01D 5/18* (2006.01)
*F01D 5/14* (2006.01)
*F01D 9/04* (2006.01)

(52) U.S. Cl.
CPC ..... *F01D 5/147* (2013.01); *F01D 5/145* (2013.01); *F01D 5/186* (2013.01); *F01D 9/041* (2013.01);

(Continued)

(58) Field of Classification Search
CPC . F01D 5/145; F01D 5/147; F01D 5/18; F01D 5/186; F01D 9/041; F05D 2240/12; F05D 2260/202
See application file for complete search history.

(56) References Cited

U.S. PATENT DOCUMENTS 3,481,531 A * 12/1969 MacArthur ..... F04D 29/284 415/914
4,229,140 A * 10/1980 Scott ..... F01D 5/141 415/115

(Continued)

FOREIGN PATENT DOCUMENTS

DE 2358521 8/1979
DE 10244199 4/2004

(Continued)

*Primary Examiner* — Audrey K Bradley
(74) *Attorney, Agent, or Firm* — Beusse Wolter Sanks & Maire

(57) ABSTRACT

The present invention relates to a turbine assembly having an aerofoil and/or an end wall each having an outer surface with a structure for directing a flow of a cooling medium at the outer surface. The structure at the outer surface has at least a first groove and a second groove extending in the outer surface from a leading to a trailing edge and being oriented in at least two different directions with a deflection angle (α) towards each other, with the deflection angle (α) having a component in a span wise direction of the aerofoil. The structure at the outer surface of the end wall has at least a first groove and a second groove extending in an axial direction of the turbine assembly, matching an outer profile of the aerofoil and oriented in at least two different directions with a deflection angle (α) towards each other.

20 Claims, 10 Drawing Sheets

(52) U.S. Cl.
CPC .... *F05D 2240/12* (2013.01); *F05D 2260/202* (2013.01)

(56) References Cited

U.S. PATENT DOCUMENTS

| | | | | |
|---|---|---|---|---|
| 6,213,711 | B1 | 4/2001 | Bell | |
| 6,368,060 | B1 | 4/2002 | Beverley | |
| 7,553,534 | B2 | 6/2009 | Bunker | |
| 2004/0265118 | A1 | 12/2004 | Greninger | |
| 2005/0123401 | A1 | 6/2005 | Bunker | |
| 2006/0163211 | A1 | 7/2006 | Coons | |
| 2006/0171809 | A1* | 8/2006 | Albrecht | F01D 5/18 416/97 R |
| 2009/0246011 | A1 | 10/2009 | Itzel | |
| 2010/0166565 | A1* | 7/2010 | Uskert | F01D 5/10 416/226 |
| 2011/0299990 | A1* | 12/2011 | Marra | B22C 9/04 416/223 A |
| 2012/0034097 | A1* | 2/2012 | Marra | F01D 5/141 416/241 R |

FOREIGN PATENT DOCUMENTS

| | | |
|---|---|---|
| EP | 0228338 | 7/1987 |
| EP | 1043480 | 10/2000 |
| EP | 1091090 | 4/2001 |
| EP | 1371813 | 12/2003 |
| EP | 1930545 | 6/2006 |
| EP | 1609949 | 9/2008 |
| EP | 1972396 | 9/2008 |
| FR | 2938871 | 5/2010 |
| GB | 1218371 | 1/1971 |
| GB | 2438861 | 12/2007 |
| JP | 57137604 | 8/1982 |

* cited by examiner

FILM COOLING OF TURBINE BLADES OR VANES

CROSS REFERENCE TO RELATED APPLICATIONS

This application is the US National Stage of International Application No. PCT/EP2012/063804 filed Jul. 13, 2012, and claims the benefit thereof. The International Application claims the benefit of European Application No. EP11176850 filed Aug. 8, 2011. All of the applications are incorporated by reference herein in their entirety.

FIELD OF THE INVENTION

The present invention relates to turbine assemblies comprising aerofoils and/or end walls, especially of turbine rotor blades and stator vanes.

BACKGROUND TO THE INVENTION

Modern gas turbines often operate at extremely high temperatures. The effect of high temperature on components of the turbine, like an aerofoil, an end wall, a turbine blade and/or stator vane, can be detrimental to the efficient operation of the turbine and can, in extreme circumstances, lead to distortion and possible failure of components or the blade or vane, respectively. In order to overcome this risk, high temperature turbines may include holes in hollow blades or vanes for film cooling purposes.

From U.S. Pat. No. 5,653,110 it is known to provide a substrate, like a blade or a combustor casing of a turbine, with inclined holes which extend through the substrate from a first surface to a second surface ending in a fluid injection point. The holes guide a cooling fluid from the first surface to the second surface, wherein the first surface is cooler than the second hot surface. The second surface has a seamless straight groove to improve the cooling effectiveness of the fluid and thus a film cooling of the hot surface of the substrate.

Problems arise when turbulence occurs at the injection point or downstream of the injection point at the hot surface and the adhesion of the fluid film to the hot surface fails leading to an insufficient cooling of the hot surface of the aerofoil.

SUMMARY OF THE INVENTION

It is an objective of the present invention to provide a turbine assembly for a gas turbine which the above-mentioned shortcomings can be mitigated, and especially a more aerodynamic efficient aerofoil and gas turbine component is facilitated.

Accordingly, an embodiment of the present invention provides a turbine assembly comprising at least a cooling object, i.e. an aerofoil or an end wall, having at least an outer surface with at least a structure for directing a flow of a cooling medium at the outer surface.

It is provided that the structure has at least a first and a second inserted guidance contour, i.e. at least a first and a second groove, which are oriented in at least two different directions with a deflection angle ($\alpha$) towards each other and which direct the flow of the cooling medium in at least two different flow directions.

Due to the inventive matter a film cooling effectiveness on the outer surface of the cooling object, e.g. a mainstream gas path surface, could be improved. This reduces efficiently the temperature of the cooling object or turbine components in general, which advantageously increases the oxidation life of the parts. Alternatively, the turbine assembly with improved film effectiveness could maintain the same temperatures, but use less cooling flow and increase the thermal efficiency of the gas turbine.

Moreover, using the guidance contour, i.e. the at least first and second groove, significantly reduces a cross stream fluctuating velocity component which forms a significant part of the turbulence or unsteadiness in the flow of the cooling medium. Hence, also a mixing across fluid layers in a boundary layer of the outer surface could be minimized which in turn reduces the heat transfer from the mainstream gas to the cooled outer surface of the cooling object.

Consequently, an efficient turbine assembly or turbine, respectively, could advantageously be provided. Moreover, due to the orientation of the guidance contours in at least two different directions the structure is advantageously matched to the flow pattern of the mainstream gas path and thus, to changes in the flow direction of the mainstream gas path due to structural circumstances.

A turbine assembly is intended to mean an assembly provided for a turbine, like a gas turbine, wherein the assembly possesses at least an object to be cooled.

The turbine assembly is preferably a part of a combustion system. The turbine assembly may be provided with at least an aerofoil and an end wall thereof. Preferably, the turbine assembly has at least a circular—or annular—turbine component, like a wheel or a cascade, with circumferential arranged aerofoils extending in radial direction from a circular inner end wall or platform, respectively. In this context an end wall is intended to mean a hub, a boss, a bearing, a carrier and/or a platform. Additionally, the turbine component, wheel or cascade may be provided with a circular outer end wall or platform, wherein the inner and the outer end wall are arranged at opposite ends of the aerofoil (s) coaxial in respect towards each other. The circular turbine component may form a full annulus or only a segment of an annulus.

A cooling object, i.e. the aerofoil or the end wall, is exposed to high temperatures and hence, had to be cooled during an operation process of the turbine.

An outer surface of the cooling object defines a surface, which is oriented to surroundings, preferably hot surroundings, of the cooling object, and especially, the mainstream gas path from a combustion chamber of the turbine assembly.

Preferably, the turbine assembly further possesses a cooling system for feeding a flow of the cooling medium to the outer surface of the cooling object.

A cooling system could be any system feasible for a person skilled in the art that is intended to provide cooling for the components of the turbine and that is able to feed a cooling medium, like a liquid and/or preferably a gas e.g. air. Preferably, the cooling system has at least a structure, which directs the flow of the cooling medium fed by the cooling system. This structure could be a cooling jacket e.g. with a water cooling, a fan and/or preferably, a component and/or structure facilitating film cooling. Preferably, this film cooling structure is arranged in direct proximity to the outer surface of the cooling object.

Further, the "guidance contour", i.e. the at least first and second groove, is purposefully and specifically chosen to guide, direct and/or influence a direction and/or a path of the flow of the cooling medium to minimize turbulence and to increase the film cooling effectiveness. The guidance contour could extend over a section or a part, respectively, of the cooling object or its outer surface and/or it could extend over a whole length of the cooling object or its surface and/or over more than one cooling object e.g. in axial direction serial arranged cooling objects. The layout, direction and/or path of the guidance contour could be empirical defined by any method feasible for a person skilled in the art, which predicts a flow pattern of the mainstream gas path, for example via fluid flow visualisation measurements or Computational Fluid Dynamics (CFD) predictions. These results could then be aligned with the mainstream flow direction locally.

The guidance contour as being "inserted" in the outer surface should be understood as the surface is being embodied with or the guidance contour is being moulded into the surface. Under the scope of the term "inserted guidance contour" should also fall a guidance contour which is formed from a coating of the surface and/or which is embodied in a coating deposited on the surface. A formation, attachment and/or insertion of the guidance contour into and/or onto the outer surface of the cooling object could be manufactured by any method feasible for a person skilled in the art, like a casting process, a machining process, an etching process, an electro discharge machining process, a spark erosion process, an electro chemical machining process, an electro plating process and a coating process. Preferably, a casting process is used. Alternatively, the surface can be built up using layers of coatings including a bond coat applied to the surface or the base metal of the surface. It is also possible to mask the surface beforehand of the coating and to remove the mask after the coating, thus creating the guidance contours or grooved elements.

To further improve the thermal and/or oxidation and/or corrosion resistance of the surface the surface could be equipped with an additional coating, like a thermal barrier coating (TBC), e.g. a ceramic TBC, an oxidation coating or a corrosion coating. Thus, the coating could advantageously have two functions first as a structure with a guidance contour and second e.g. as a thermal and/or an oxidation, and/or a corrosion barrier.

Two different directions with a deflection angle ($\alpha$) towards each other define directions which deflect from one another with an angle ($\alpha$) from 0.5° up to 90 °, preferably up to 60° and particularly advantageously up to 50°. With the latter it has been shown that sufficient cooling properties could be achieved. Especially advantageous is an arrangement where the at least two inserted guidance contours, i.e. the at least first and second groove, have a deflection angle ($\alpha$) of 45° in respect towards each other. Preferably, the at least two inserted guidance contours lie in one plane. Advantageously, the at least two inserted guidance contours build a multidimensional flow field, thus providing a satisfactory spatial coverage of cooling.

Beneficially, the at least first and second guidance contour each have at least two controlled arranged elements. The elements could be any structure suitable for a person skilled in the art, like a tube, a bar, a channel and/or a groove. With these elements the flow of the cooling medium could be directed homogenously. Due to the deflection of the two guidance contours from one another, consequently, an element of the first guidance contour and an element of the second guidance contour deflect in their direction from one another. Preferably, said elements are arranged controlled in respect towards each other, thus providing a well regulated pattern of the first and/or second guidance contour. Especially, said elements are arranged basically parallel, preferably parallel, in respect towards each other. In the scope of the wording "basically parallel" should also lie an arrangement of the elements wherein the elements deflect slightly from each other, like with a degree up to 10°. Further, the elements could extend equispaced in respect to each other. Due to the parallel arrangement the mixing in the boundary layer could easily reduced at long distance downstream of the cooling system. Moreover, the at least first and second guidance contour could share the same element. Additionally, also selected sections of elements of one guidance contour could be arranged deflected in respect to other sections of the same elements. For example selected sections of the elements could extend basically straight and/or in parallel in respect to each other and the other sections may be not arranged in parallel and could follow e.g. an arch.

Preferably, the at least first and second guidance contours has each at least one groove providing a cost-effectively pattern or structure which for example could be manufactured easily and effortlessly. The groove preferably has an angular, square or stepped contour or profile. Generally, any other shape of the profile of the groove feasible for a person skilled in the art, like round, conic, tapered or dovetail shaped, is possible. Particularly, the two controlled arranged elements are two grooves, which are advantageously arranged in parallel in respect to each other.

In an advantageous embodiment a distance quotient (P/H) referring to a distance or pitch (P) and a height (H) between said two elements of the at least first and second guidance contour is greater than or equal to 1 and less than or equal to 30. A distance quotient (P/H) is calculated as a length (P) between an endpoint of a first element and an endpoint of a following second element divided by a height (H) of the first and/or second element ($1 \leq P/H \leq 30$). Basically, the distance quotient could also be calculated out of a length P* between two centres or maxima or minima of a first and a second element divided by a height of the first and/or second element. Computationally it has turned out that these relation and/or values provide an efficient film cooling.

Moreover, it could be advantageous if a clearance quotient (W/H) referring to a clearance (W) and a height (H) between two elements the at least first and/or second guidance contour is greater than or equal to 0.2 and less than or equal to 20. A clearance quotient (W/H) is calculated as a length or width (W) between an endpoint of a first element and a start point of a following second element divided by a height (H) of the first and/or second element ($0.2 \leq W/H \leq 20$). Such a relation or those values have proved particularly successful in film cooling purposes.

With the cooling object being the aerofoil the at least first groove and second groove extend in an outer surface of the aerofoil basically from a leading edge to a trailing edge of the aerofoil and being oriented in the at least two different directions with the deflection angle ($\alpha$) towards each other with said deflection angle ($\alpha$) having a component in a span wise direction of the aerofoil.

Advantageously, the outer surface is the pressure face of the aerofoil. Due to this arrangement the guidance contour could be advantageously matched to the orientation of the aerofoil and the mainstream gas path and thus providing an effective cooling for the aerofoil.

With the cooling object being the end wall, the end wall is arranged basically perpendicular in respect to a span wise direction of the aerofoil.

In this context an arrangement of "an end wall" as "basically perpendicular to the span wise direction of the aerofoil" means that the outer surface of the end wall is arranged basically perpendicular to a radial direction and/or a span wise direction of the respective aerofoil, wherein a span wise direction of the aerofoil is defined as a direction ex-tending basically perpendicular, preferably perpendicular, to a direction from the leading edge to the trailing edge of the aerofoil. In the scope of an arrangement of the outer surface of the end wall as "basically perpendicular" to the span wise direction should also lie a divergence of the outer surface in respect to the span wise direction of about 30°. Preferably, the outer surface of the end wall is arranged perpendicular to the span wise direction. According to this feature of the invention, a structure that is exposed to particularly high temperatures could be efficiently cooled.

Moreover, the at least first groove and second groove extend in an outer surface of the end wall basically in an axial direction and match an outer profile of the aerofoil, preferably the at least first groove and second groove being in line with extending along the profile from a leading edge to a trailing edge of the aerofoil.

An axial direction is intended to mean a direction along the mainstream gas path and/or an axial direction of the turbine. The term "profile" should be understood as equivalent to outline, shape and/or contour. Further, in respect to two aerofoils, which are arranged in circumferential direction of the end wall, the first and/or second guidance contour is arranged between these two aerofoils. Due to such an embodied guidance counter or contours the cooling effect and efficiency of the contour (s) could be selectively adjusted to the flow path of the hot mainstream gas path influenced by the shape of the aerofoil (s).

In a further advantageous embodiment the cooling system has at least a film cooling injection point to feed the flow of the cooling medium to at least one of the first and/or second guidance contours. Due to this, the flow of the cooling medium could be applied to the guidance contour (s) purposefully and easily. Moreover, the cooling system could have more than one film cooling injection point, which could be arranged e.g. in series in span wise direction of the aerofoil or in axial direction of the aerofoil or the turbine, respectively, and/or in circumferential direction. Thus, the cooling medium could be feed with different properties, like temperature, pressure and/or composition, and/or over a wide area of the turbine assembly. Advantageously, the film cooling injection point is a part of an impingement system, hence, providing an effective injection.

The film cooling injection point could be embodied as any structure suitable for a person skilled in the art, like a valve, a nozzle, an impeller and/or in particular an opening. By means of an opening the film cooling injection point could be constructed and manufactured cost-effective. Advantageously, the film cooling injection point is a hole and/or a slot, wherein it saves space and costs. Typical film cooling holes, especially in the case of small gas turbines of the order of 10 MW, are between of 0.4 mm to 4 mm, the latter in larger engines. In combustion systems the holes may be in the range of up to 30 mm. Embodied as a slot, it could extend e.g. in span wise direction in the outer surface of the aero-foil or at least along a part of the circumference of the end wall and preferably along the entire circumference of the end wall. The film cooling injection point is embodied in such a way that the cooling medium exits the film cooling injection point in stream wise direction. Providing an edge of the opening and/or hole and/or slot, which is arranged inclined in respect to the outer surface of the cooling object, easily allows the flow of the cooling medium to exit in this predetermined direction.

In addition, it is provided that the film cooling injection point is arranged in axial direction and/or in stream wise direction between two aerofoils and in particular, between an aerofoil of a guide vane and an aerofoil of a rotor disc or vice versa. Thus, the film cooling injection point could be realised without much efforts. Moreover, a structural impairment of the aerofoil could be avoided.

In an advantageous embodiment a rim seal forms an opening of the cooling system resulting in saving of costs, pieces, space and/or assembly efforts. Alternatively, the seal could be embodied as a labyrinth seal. Moreover, the opening is embodied as a slot, which extends at least over a part of the circumference of the rim seal and preferably over the entire circumference of the rim seal. Generally, other pieces or structures feasible for a person skilled in the art could form an opening of the cooling system, like an abutment region of the end wall with a turbine component which is arranged upstream of the aerofoils or a guide vane, respectively, and is e.g. a housing of a transition duct, which guides hot gases from the combustion chamber to the turbine.

To provide the turbine assembly with good cooling properties at least one of the first and/or second guidance contours is arranged in axial direction and in stream wise direction downstream of the film cooling injection point of the cooling system. Thus, the guidance contour (s) could distribute and lead the flow of the cooling medium at long distance down-stream of the injection point where cooling is needed. Even if the cooling medium is not fed directly to this downstream region via the film cooling injection point it could be effectively cooled.

Advantageously, it is also possible, that the guidance contour starts, viewed in axial direction, upstream of the film cooling injection point of the cooling system. Or in other words, the guidance contour (s) or the controlled arranged elements or the grooves, respectively, extend in a contrariwise direction to the stream wise or axial direction beyond the film cooling injection point. This is especially advantageous in case of the end walls. There, the guidance contour(s) could for example be inserted into or onto a surface of the inner housing arranged in stream wise direction before the end wall. Due to this, a mixing of the different gas streams could happen especially gently.

In a further advantageous embodiment the aerofoil is a turbine blade or vane, for example a nozzle guide vane. The invention could be applied to a circular aerofoil component, like a turbine wheel or a turbine cascade or a turbine annulus or turbine nozzle, for a turbine assembly with at least an aerofoil, oriented in a radial direction of the aerofoil component and having at least an outer surface and with an end wall having at least an outer surface, arranged basically perpendicular to the outer surface of the aerofoil, wherein at least one of the outer surfaces have the structure, which direct a flow of a cooling medium fed by a cooling system.

Thus, a film cooling effectiveness on the outer surface of the aerofoil and/or the end wall, like mainstream gas path surfaces, could be improved. Due to this, the temperature of the aerofoil, the end wall or the turbine components in general could be efficiently reduced, which in turn advantageously increases the oxidation life of the parts. Alternatively, the turbine assembly with improved film effectiveness could maintain the same temperatures, but use less cooling flow and increase the thermal efficiency of the gas turbine. Further, the usage of the guidance contours significantly reduces a cross stream fluctuating velocity component which forms a significant part of the turbulences or unsteadiness in the flow of the cooling medium. In addition, the guidance contours minimize mixing across fluid layers in a boundary layer of the outer surface, consequently leading to a reduction of the heat transfer from the mainstream gas to the cooled outer surface of the aerofoil and/or the end wall.

As a result, an efficient aerofoil component or turbine, respectively, could advantageously be provided. Moreover, due to the orientation of the guidance contours in at least two different directions the structure can be advantageously matched to the flow pattern of the mainstream gas path and thus, to changes in the flow direction of the mainstream gas path due to structural circumstances.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The present invention will be described with reference to drawings in which.

DETAILED DESCRIPTION OF THE ILLUSTRATED EMBODIMENT

Figure 1:
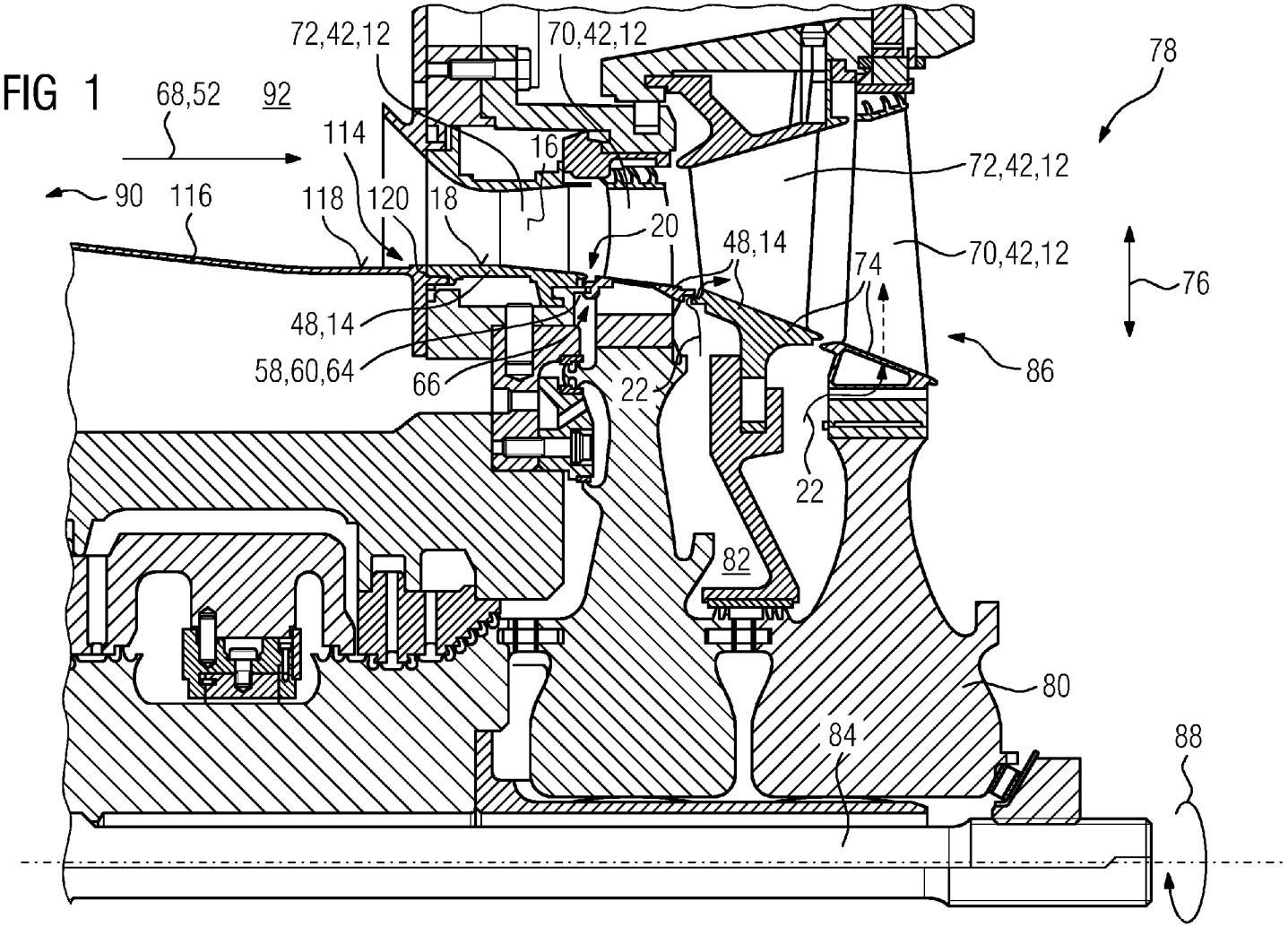
FIG. 1: shows a cross section of a gas turbine with a turbine assembly comprising rotor discs and stator vanes.

FIG. 1 shows a cross section of a gas turbine 78 with a turbine assembly 10 comprising aerofoil components 74 embodied as turbine wheels with rotor discs 80 arranged in a disc cavity 82 rotatably around a shaft 84 and turbine cascades with stator vanes 72 stationary arranged around the shaft 84. At radial outer end region 86 of each turbine wheel and cascade a circular end wall 48 is arranged in circumferential direction 88 coaxial around the shaft 84. Each end wall 48 has aerofoils 42 or blades 70 or vanes 72, respectively, which extend from an outer surface 18 of the end wall 48 in radial direction 76 of the aerofoil component 74. In the following description blades 70 and vanes 72 are generally referred as aerofoil 42. In circumferential direction 88 of the end wall 48 there are several aerofoils 42 arranged one after another (not shown). A combustion chamber 90 (not shown in detail) is arranged in stream wise direction 68 upstream of the disc cavity 82. Hot gases originating from the combustion chamber 90 flow in stream wise direction 68 and in axial direction 52 of the turbine 78 along a mainstream gas path 92 to end regions 86 of the turbine wheels and cascades. During operation of the turbine 78 the aerofoils 42 and the end walls 48 are positioned in the mainstream gas path 92 and thus, are exposed to high temperatures, which could be detrimental to these turbine components and hence, efficient cooling is needed. Therefore, each aerofoil 42 and each end wall 48 are cooling objects 12, 14, which have to be cooled by means of a cooling system 20. Especially, outer surfaces 16, 18 of the cooling objects 12, 14, which are oriented towards the main-stream gas path 92, have to be cooled with the cooling system 20, which feeds a flow 22 of a cooling medium to the outer surfaces 16, 18 of the cooling objects 12, 14 or the aerofoils 42 and end walls 48, respectively. The outer surface 16 is e.g. the pressure face 94 of the aerofoil 42 (see FIG. 2).

Figure 2:
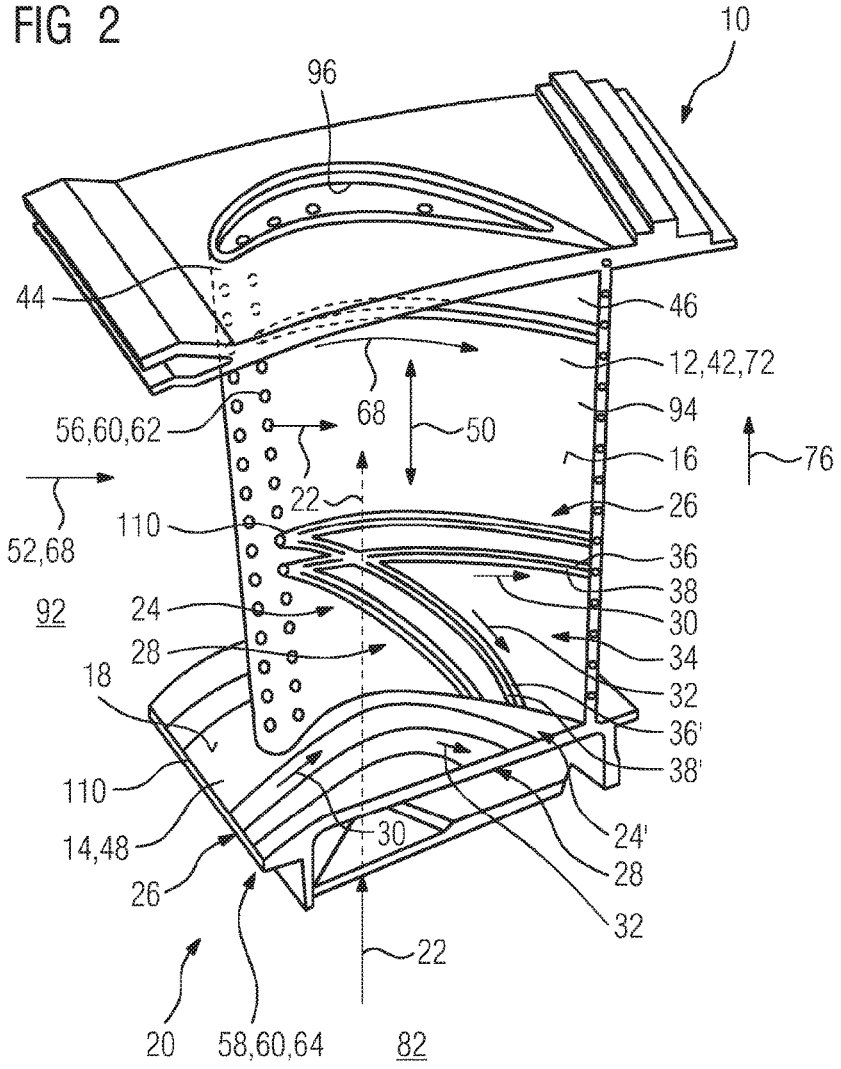
FIG. 2: shows a perspective view of an aerofoil with an end wall of the turbine assembly of FIG. 1, FIG. 3: shows an enlarged view of a section of the turbine assembly of FIG. 1, FIG. 4: shows schematically the arrangement of a film cooling injection point and a structure of a cooling system of the turbine assembly of FIG. 1, FIG. 5: shows schematically a geometry of a guidance contour of a structure from FIG. 4, FIG. 6: shows a possible pattern of the guiding contours on a surface of the aerofoil of FIG. 2, FIG. 7: shows an alternative pattern of the guiding contours of the surface of the aerofoil of FIG. 2, FIG. 8: shows a possible pattern of the guiding contours on a surface of the end wall of FIG. 2, FIG. 9: shows a diagram comparing to the film cooling effectiveness of turbine assemblies with and without inserted guidance contours.
Figure 3:
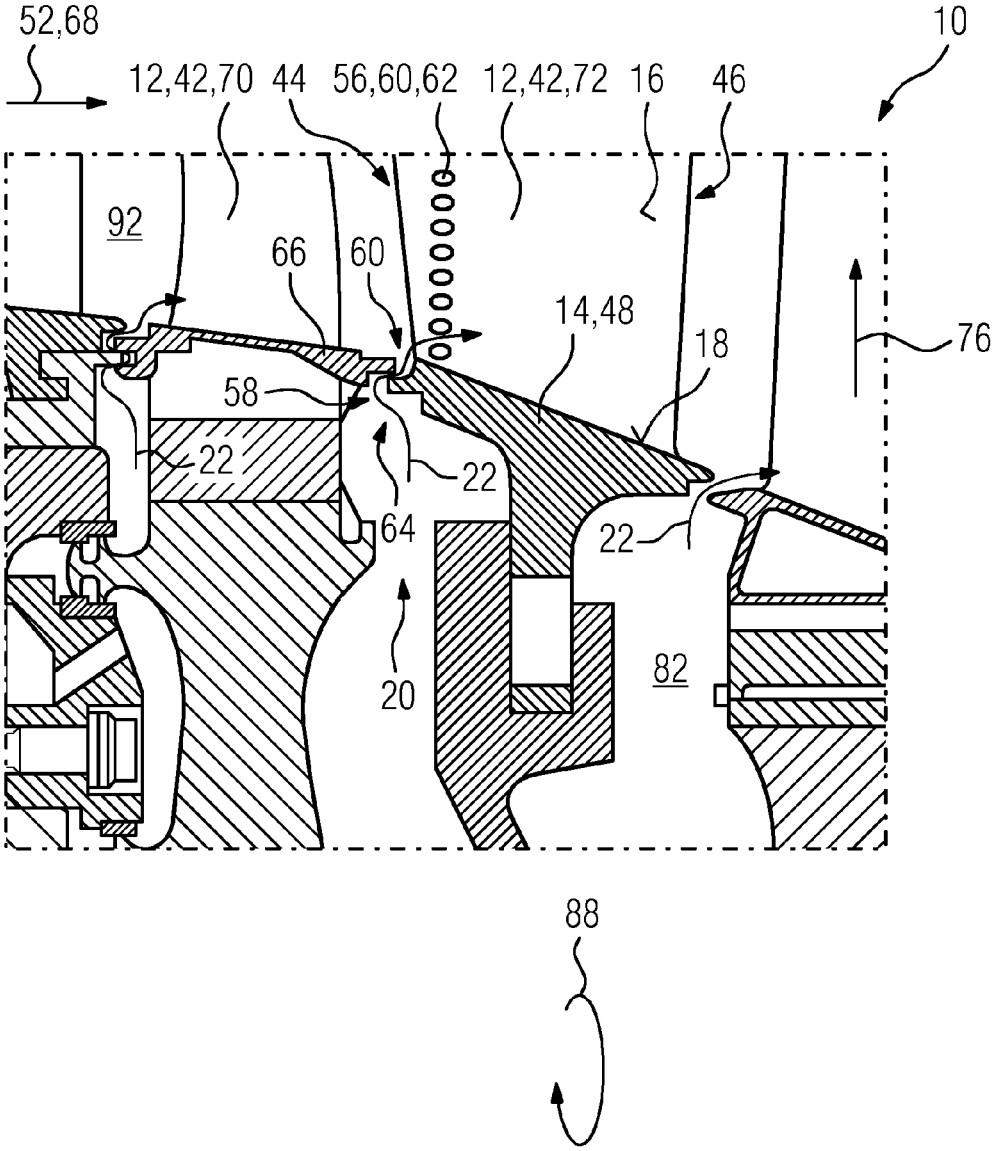

To supply the outer surfaces 16, 18 with cooling medium the cooling system 20 has film cooling injection points 56, 58, embodied as openings 60 as could be seen in FIGS. 2 and 3. A series of film cooling injection points 56 are arranged at a leading edge 44 of the aerofoil 42 in radial direction 76 of the aerofoil component 74 and are embodied as holes 62 (see FIG. 2) . A flow 22 of cooling medium, like air, is feed from the disc cavity 82 through a not shown opening of the end wall 48 into an impingement tube 96 (only schematically shown), arranged in an inner cavity of the aerofoil 42 and in a span wise direction 50 of the aerofoil 42, and exits the impingement tube 96 trough the film cooling injection points 56. Additionally, rim seals 66, arranged in axial direction 52 between end walls 48 of aerofoils 42 of the turbine wheels and cascades, form the film cooling injection points 58 or the openings 60 (see FIG. 3). Thus, the openings 60 are embodied as slots 64, which extend in circumferential direction 88 coaxial to the shaft 84 over an entire circumference of the rim seals 66. A flow 22 of cooling medium flows out from the disc cavity 82 through the rims seals 66 into the mainstream gas path 92.

Figure 4:
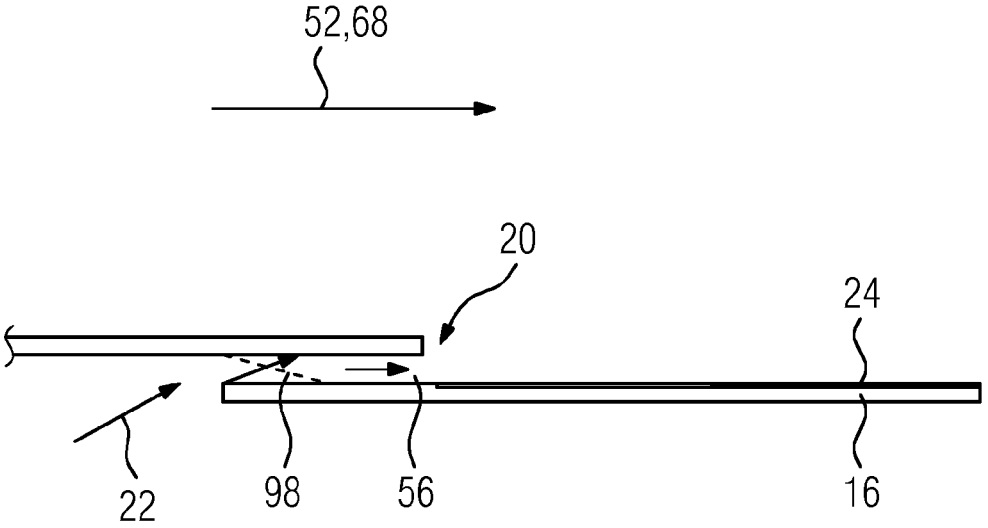

To enhance a film cooling efficiency, the cooling system 20 has structures 24, 24', which direct the flow 22 of the cooling medium fed by the cooling system 20 and which are arranged at the outer surfaces 16, 18 of the cooling objects 12, 14. FIG. 4 shows, in a schematically view, a general arrangement of a film cooling injection point 56 in respect to a structure 24 in surface 16 (the same could be true for film cooling injection point 58, structure 24' and surface 18). It could be seen, that an especially improved feeding could be provided, if the opening 60 of the cooling system 20 is embodied with an impingement system 98 (see arrows of flow 22). As shown in FIG. 2, each structure 24 has a first inserted guidance contour 26 and a second inserted guidance contour 28. These guidance contours 26, 28 are oriented in two different directions 30, 32 and thus, direct the flow 22 of the cooling medium in two different flow directions 30, 32. Thus, the first and second inserted guidance contour 26, 28 build a multidimensional flow field 34. Therefore, the guidance contours 26, 28 take into account the changes in direction of the mainstream gas path 92.

Figure 5:
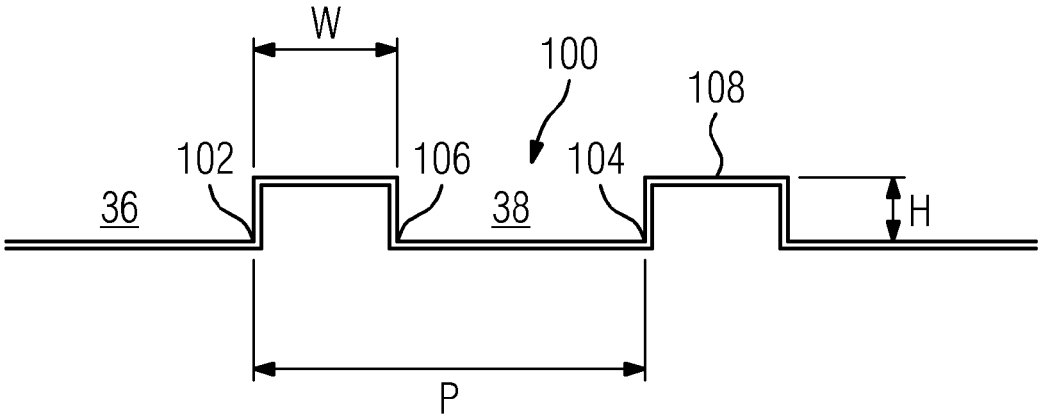
Figure 6:
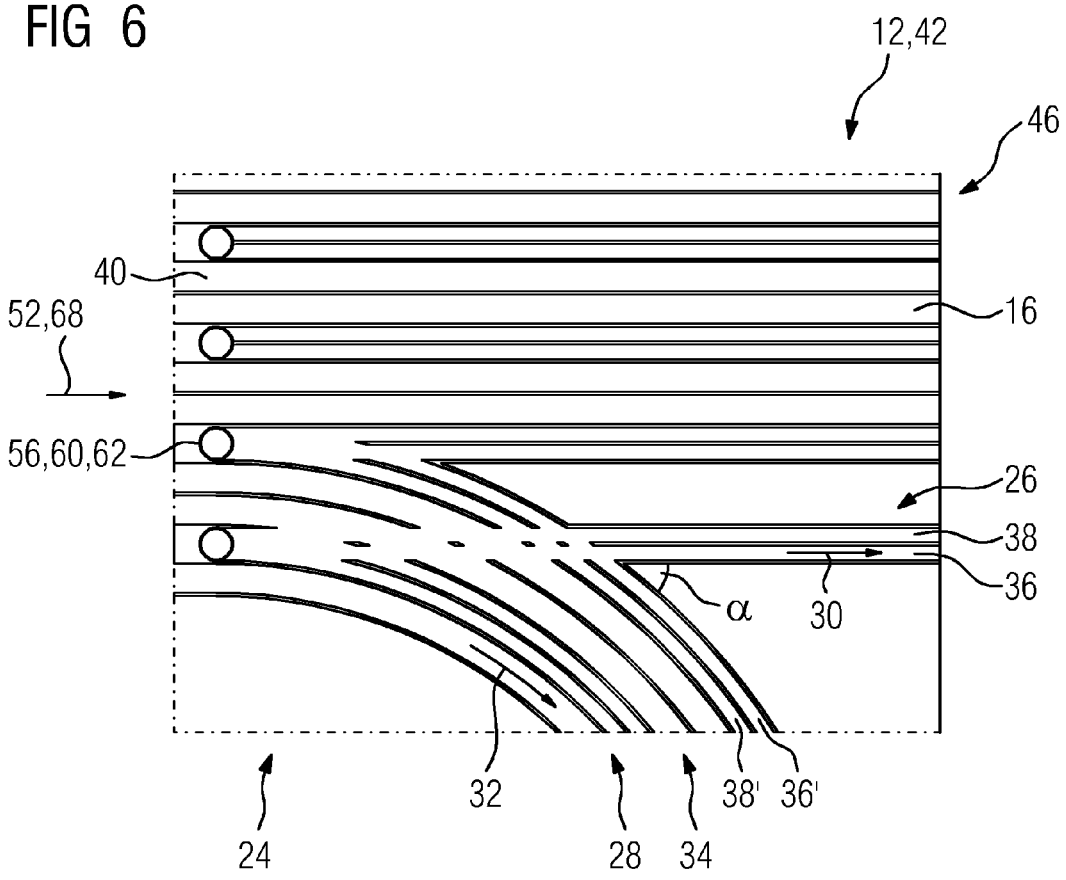
Figure 7:
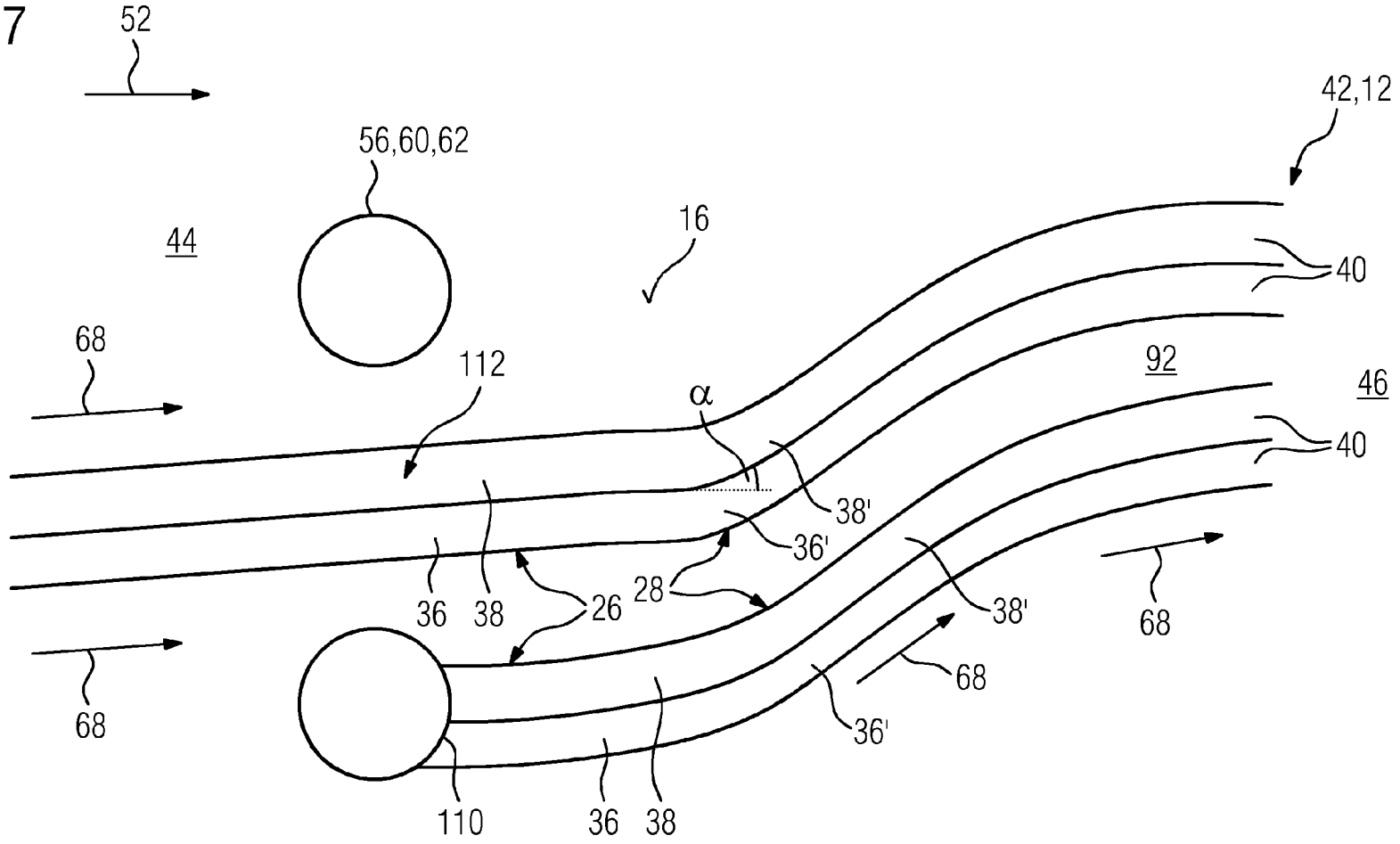
Figure 8:
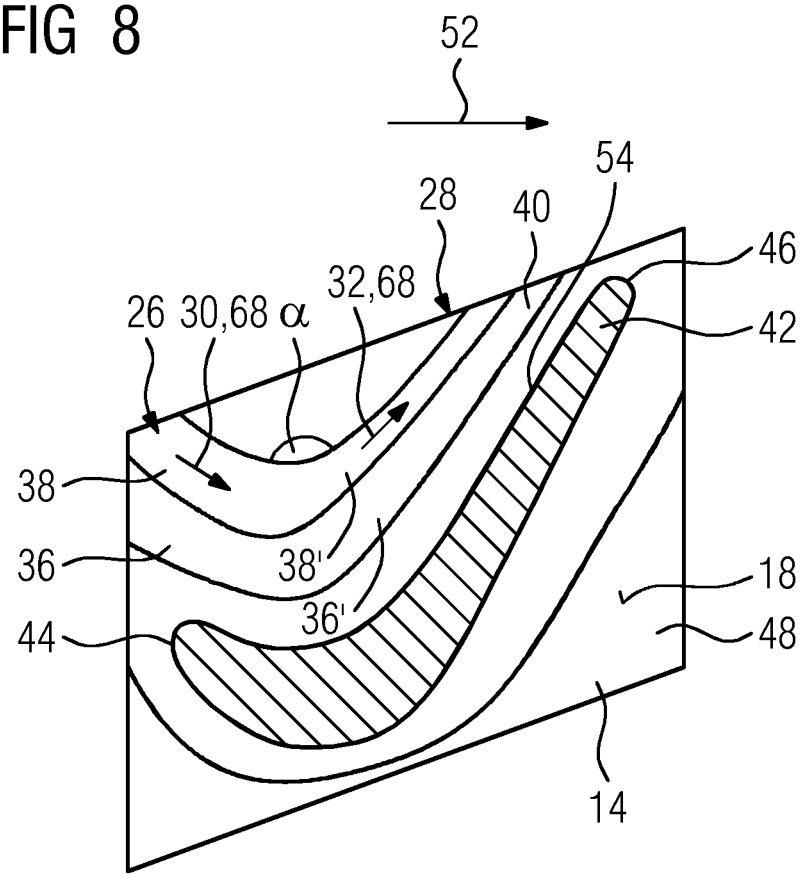

As could be seen in detail in FIGS. 6 to 8 the first guidance contour 26 and second guidance contour 28 each have several controlled arranged elements 36, 36', 38, 38' (for clarity not shown in FIGS. 1 and 3; in FIGS. 6 to 8 only two elements for each contour are shown or provided with reference numerals in the drawings and in FIG. 2 only some elements 36, 36', 38, 38' are shown, generally they can be provided for each hole 62), wherein these elements 36, 36', 38, 38' are arranged controlled in respect towards each other or basically parallel in respect towards each other. The first and second guidance contours 26, 28 have each several groove 40 or the elements 36, 36', 38, 38' are embodied as grooves 40. These grooves 40 have an angular profile 100 as could be seen in FIG. 5. A distance quotient P/H is greater than or equal to 1 and less than or equal to 30 ($1 \leq P/H \leq 30$). Moreover, a clearance quotient W/H is greater than or equal to 0.2 and less than or equal to 20 ($0.2 \leq W/H \leq 20$). P is the distance between two elements 36, 38, wherein the distance is defined as the length between an endpoint 102 of a first element 36 and an endpoint 104 of a following second element 38. W is the clearance between two elements 36, 38, wherein the clearance is defined as the length between an endpoint 102 of the first element 36 and a start point 106 of a following second element 38. H is the height of an element 36, 38 (exemplary shown in FIG. 5 for elements 36 and 38). For example, the aerofoil 42 has in span wise direction 50 a length of 30 cm, with several holes 62. Typical film cooling holes are between 0.4 mm to 4 mm. Holes 62 have e.g. a diameter of about 2 mm. In this case P could have a length of 0.5 mm, W of 0.1 mm and H of 0.1 mm, consequently, P/H is 5 and W/H 1.

The first and second guidance contours 26, 28 are manufactured into the outer surfaces 16, 18 of the cooling object 12, 14 or the aerofoil 42 and the end wall 48, respectively, via a casting process during manufacturing of the aerofoil 42 and the end wall 48. The surfaces 16, 18 are embodied with an additional thin coating 108 for thermal, oxidation and corrosion resistance. Thus, the coating 108 is a thermal barrier coating (TBC), like a ceramic TBC.

As stated above one cooling object 12 is an aerofoil 42 (see FIG. 2). The first guidance contour 26 and the second guidance contour 28 extend in the outer surface 16 or the pressure face 94 of the aerofoil 42 basically from the leading edge 44 to a trailing edge 46 of the aerofoil 42 and in case of the first guidance contour 26 along a whole axial length of the outer surface 16 or the aerofoil 42. The guidance contours 26, 28 start in stream wise direction 68 downstream of the holes 62 and in case of the first guidance contour 26 immediate at edges 110 of the holes 62. Thus, the guidance contours 26, 28 are arranged in axial direction 52 and in stream wise direction 68 downstream of the film cooling injection point 56, wherein the latter feeds the flow 22 of the cooling medium to the first and second guidance contours 26, 28.

FIG. 6 shows a possible pattern of the guidance contours 26, 28 in the outer surface 16 of the aerofoil 42 in a frontal view. The first guidance contour 26 is embodied as a plurality of parallel and straight elements 36, 38 or grooves 40 extending from edges 110 of the holes 62 in stream wise direction 68. The second guidance contour 28 is embodied as a plurality of basically parallel and curved elements 36', 38' extending either from the edges 110 of the holes 62 or from an element 36, 38 of the first guidance contour 26 or between two elements 36 and 38. The first inserted guidance contour 26 and the second inserted guidance contour 28 cut across each other and have a deflection angle $\alpha$ of about 45° in respect towards each other. Hence, the first and second inserted guidance contours 26, 28 are oriented in two directions 30, 32 being arranged with an angle $\alpha$ of 45° towards each other. Consequently, the two guidance contours 26, 28 direct the flow 22 of the cooling medium in two flow directions 30, 32 with an angle $\alpha$ of 45°. Moreover, the first and second guidance contours 26, 28 lie in one plane and build a flow field 34. The guidance contours 26, 28 significantly reduce turbulences or unsteadiness in the flow 22 of the cooling medium. Hence, also a mixing across fluid layers in a boundary layer of the outer surface 16 could be minimized which in turn increases the heat transfer from the mainstream gas to the cooled outer surface 16 of the cooling object 12. Further, due to the arrangement of the aerofoils 42 and especially, the vanes 72 in the mainstream gas path 92 they effect the direction of the mainstream gas. By means of such constructed guidance contours 26, 28, the change of direction of the mainstream gas can be taken into account.

In FIG. 7 an alternative pattern of the guidance contours 26, 28 in the outer surface 16 of the aerofoil 42 is shown. The first guidance contour 26 is embodied as a plurality of parallel and straight elements 36, 38 extending from edges 110 of the holes 62 or spaces 112 between holes 62 in stream wise direction 68. Some of the elements 36, 38 start, viewed in axial direction 52, even upstream of the film cooling injection points 56 or holes 62 at the leading edge 44. The second guidance contour 28 affiliates to the first guidance contour 26 and is embodied as a plurality of parallel, in the beginning curved and thereafter straight elements 36', 38'. The elements 36, 38 are the same structures as the elements 36' and 38'; thus, elements 36, 36' and 38, 38' are different sections of the same elements or grooves 40. The first inserted guidance contour 26 and the second inserted guidance contour 28 have a deflection angle $\alpha$ of about 45° in respect towards each other. Due to this, the stream wise direction 68 varies along the mainstream gas path 92 (see different orientation of arrows indicating the stream wise direction 68).

FIG. 8 shows a top view of the outer surface 18 of the end wall 48 with a cross section along the axial direction 52 of the aerofoil 42. As stated above a further cooling object 14 is an end wall 48. The end wall 48 is arranged perpendicular in respect to the span wise direction 50 of an aerofoil 42 and the outer surface 18 of the end wall 48 is arranged perpendicular to the outer surface 16 of the aerofoil 42 (see FIG. 2) . The first and second guidance contour 26, 28 extend in the outer surface 18 of the end wall 48 basically in axial direction 52 and match an outer profile 54 of the aerofoil 42. Moreover, the guidance contours 26, 28 extend along the profile 54 from the leading edge 44 to the trailing edge 46 of the aerofoil 42.

The first guidance contour 26 is embodied as a plurality of parallel and straight elements 36, 38 extending from edges 110 of the rim seals 66 in stream wise direction 68 and hence, is arranged in axial direction 52 and in stream wise direction 68 downstream of the film cooling injection point 58 (see FIGS. 2 and 3). The elements 36, 38 start, viewed in axial direction 52, even upstream of the first film cooling injection point 58 or slot 64 or rim seals 66, respectively (see FIG. 1). Thus, an abutment region 114 arranged between a turbine component in the form of a housing 116 of a transition duct guiding hot gases from the combustion chamber 90 to the turbine 78 and the end wall 48 in most proximity to the combustion chamber 90 is embodied with a surface 118 having an inserted guidance contour 26 with parallel elements 36, 38 (not shown in detail). In addition, a leakage gap 120 between the housing 116 and the end wall 48 can function as film cooling injection point. The second guidance contour 28 affiliates to the first guidance contour 26 and is embodied as a plurality of parallel elements 36', 38'. The first inserted guidance contour 26 and the second inserted guidance contour 28 have a deflection angle $\alpha$ of about 90° in respect towards each other.

As could be seen in FIG. 3, which shows an enlarged view of a section of the turbine assembly 10 of FIG. 1, the slots 64 of the rim seals 66 are inclined in respect to the axial direction 52 and thus, the flow 22 of the cooling medium is injected in the mainstream gas path 92 in a predetermined direction and specifically in a direction with a vector in stream wise or axial direction 52, 68. Additionally, the holes 62 are preferably inclined accordingly.

Figure 9:
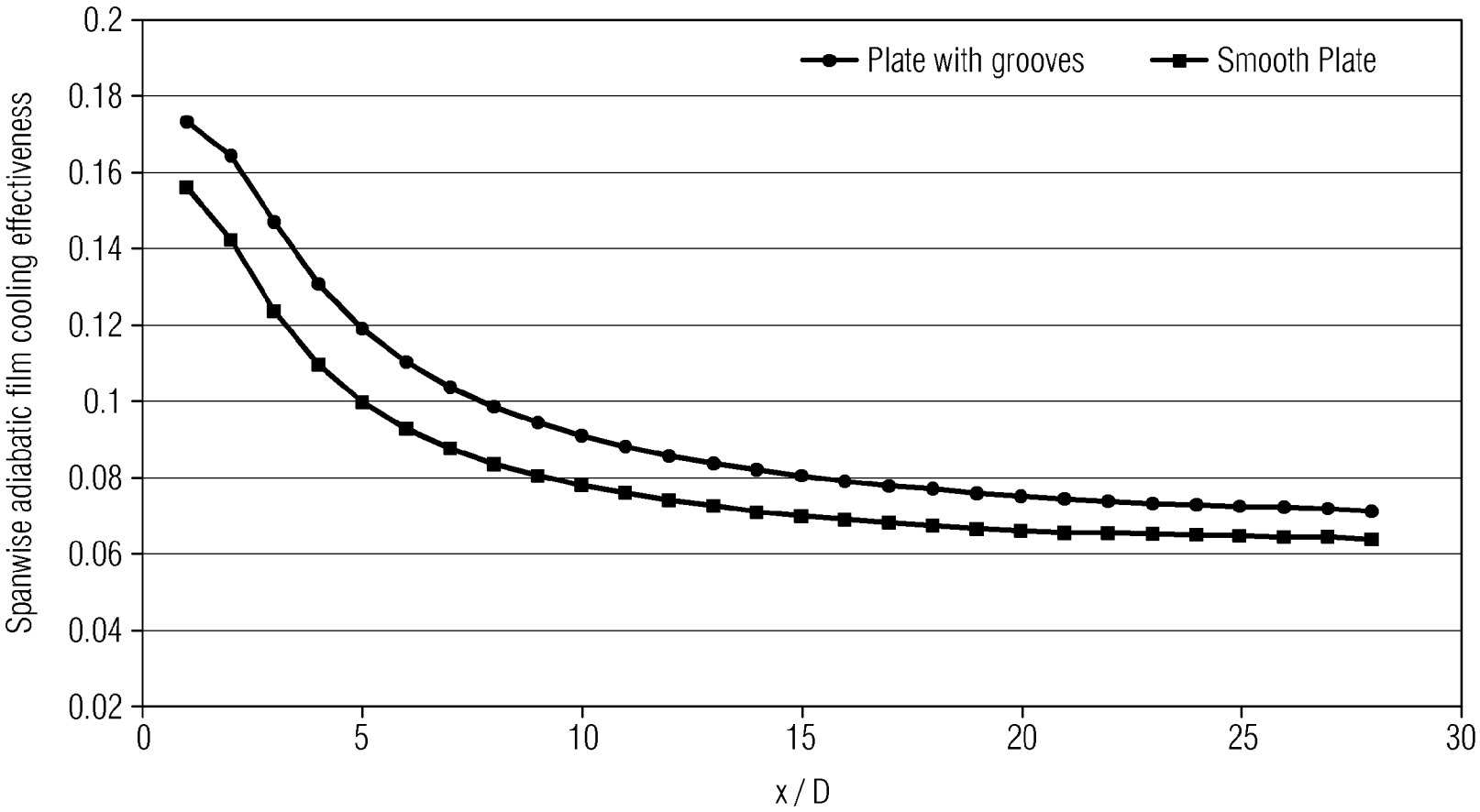

FIG. 9 shows in a diagram the results of two different experimental setups, where the film cooling effectiveness of the cooling object 12 or the aerofoil 42 with the guidance contours 26, 28 according to the invention is compared to the film cooling effectiveness of a cooling object with a smooth surface. The y-axis refers to the span wise adiabatic film cooling effectiveness, and on the x-axis x/D is plotted, wherein x is the stream wise distance from the centre of the film cooling injection point 56 or hole 62, respectively, and D is the diameter of film cooling injection point 56 or hole 62. As could be seen, at all measuring points the film cooling effectiveness of the object 12 with guidance contours 26, 28 is better than that of an object with a smooth surface.

Comparable results could be obtained for cooling object 14 or end wall 48, respectively.

Figure 10A:
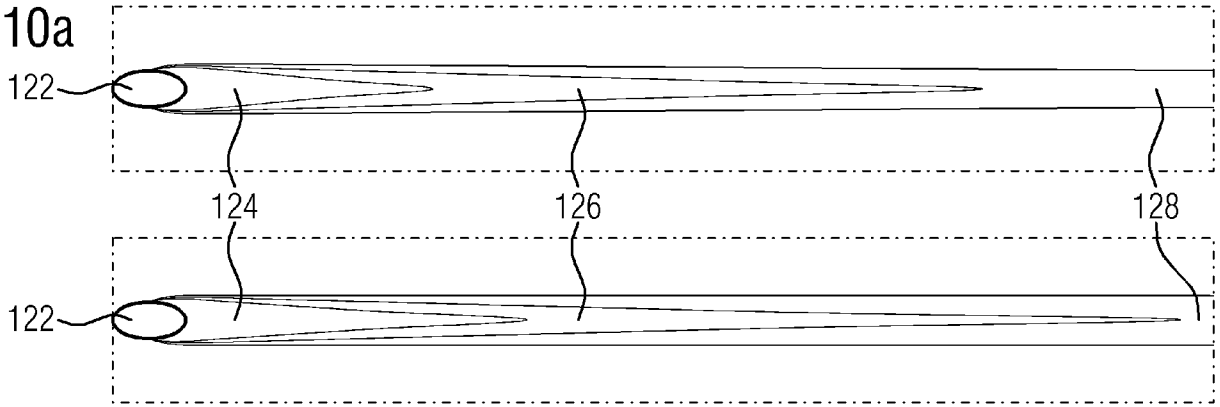
FIG. 10*a*: shows a temperature distribution of aerofoils with and without an inserted straight guidance contour
Figure 10B:
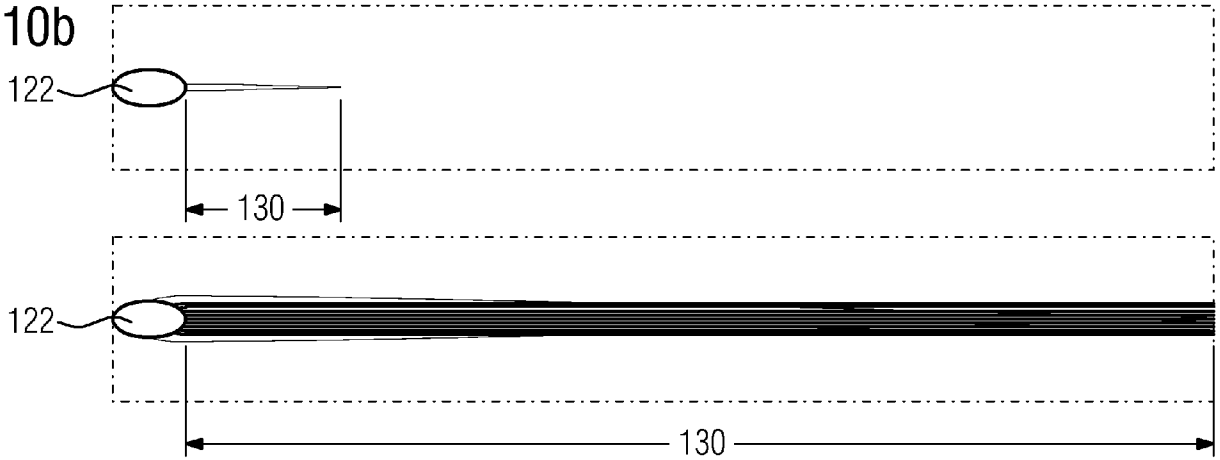
FIG. 10*b*: shows a turbulence distribution of aerofoils with and without an inserted straight guidance contour.

FIG. 10 depicts the advantages of objects with guidance con-tours on the basis of an aerofoil with straight and parallel grooves. The principles shown could also be applied to the cooling objects 12, 14 of the invention. In FIG. 10*a* the temperature distributions of an aerofoil with grooves (bottom half) and an aerofoil with a smooth surface (upper half) are compared. For both aerofoils the temperature rises in dependency from the distance from a film cooling injection opening 122. But the coldest temperature area 124 after the film cooling injection opening 122 is bigger for the aerofoil with grooves in comparison with the smooth aerofoil. The same is true for the following warmer temperature areas 126 and 128. FIG. 10*b* shows a comparison of turbulence distributions of an aerofoil with grooves (bottom half) and an aerofoil with a smooth surface (upper half). A distance 130 with minimum turbulences after the injection opening 122 is much smaller for the smooth aerofoil than for the aerofoil with grooves. For the aerofoil with grooves even the distinct pattern of the grooves can be seen in the turbulence plot.

For the embodiments, an axial direction is defined parallel to an axis of rotation. A radial direction is defined perpendicular to the axial direction. Furthermore a circumferential direction may be defined as a direction perpendicular to the axial direction and perpendicular to the radial direction defining a direction perpendicular to a main fluid flow.

Although the invention is illustrated and described in detail by the preferred embodiments, the invention is not limited by the examples disclosed, and other variations can be derived therefrom by a person skilled in the art without departing from the scope of the invention.

The invention claimed is:

1. A turbine assembly comprising:

an aerofoil comprising an outer surface, the outer surface comprising a structure configured to direct a flow of a cooling medium at the outer surface during operation of a turbine, wherein the outer surface defines a mainstream gas path surface, wherein the structure comprises a first groove and a second groove, wherein the first groove and the second groove extend in the outer surface of the aerofoil from a leading edge to a trailing edge of the aerofoil and are oriented in at least two different directions with a deflection angle ($\alpha$) towards each other, wherein said deflection angle ($\alpha$) has a component in a span wise direction of the aerofoil, and wherein the first groove and the second groove cut across each other.

2. The turbine assembly according to claim 1, wherein the deflection angle ($\alpha$) is up to 45°.

3. The turbine assembly according to claim 1, further comprising several first grooves and/or several second grooves, wherein a distance quotient (P/H) referring to a distance (P) between two adjacent grooves of the several first grooves and a height (H) of the several first grooves is greater than or equal to 1 and less than or equal to 30 and/or wherein a distance quotient (P/H) referring to a distance (P) between two adjacent grooves of the several second grooves and a height (H) of the several second grooves is greater than or equal to 1 and less than or equal to 30.

4. The turbine assembly according to claim 1, further comprising several first grooves and/or several second grooves, wherein a clearance quotient (W/H) referring to a clearance (W) between two adjacent first grooves of the several first grooves and a height (H) of the several first grooves is greater than or equal to 0.2 and less than or equal to 20 and/or wherein a clearance quotient (W/H) referring to a clearance (W) and a height (H) between two adjacent second grooves of the several second grooves and a height (H) of the several second grooves is greater than or equal to 0.2 and less than or equal to 20.

5. The turbine assembly according to claim 1, wherein the first groove and/or the second groove are manufactured into and/or onto the outer surface via a process selected from a group consisting of a casting process, a machining process, an etching process, an electro discharge machining process, a spark erosion process, an electro chemical machining process, an electro plating process and a coating process.

6. The turbine assembly according to claim 1, wherein the aerofoil is a turbine blade or vane.

7. The turbine assembly according to claim 1, further comprising several first grooves and/or several second grooves.

8. The turbine assembly according to claim 7, wherein the several first grooves are parallel towards each other and/or the several second grooves are parallel towards each other.

9. The turbine assembly according to claim 1, further comprising a cooling system for feeding the flow of the cooling medium to the outer surface.

10. The turbine assembly according to claim 9, wherein the cooling system comprises a slot configured to feed the flow of the cooling medium to the first groove and/or the second groove.

11. The turbine assembly according to claim 9, wherein the cooling system comprises a hole configured to open into the first groove or the second groove.

12. The turbine assembly according to claim 9, further comprising a rim seal which forms an opening of the cooling system.

13. The turbine assembly according to claim 9, wherein the first groove and/or the second groove are arranged in an axial direction and in a stream wise direction downstream of a film cooling injection point of the cooling system.

14. A turbine assembly comprising:

an aerofoil comprising an outer surface, the outer surface comprising a structure configured to direct a flow of a cooling medium at the outer surface during operation of a turbine, wherein the outer surface defines a mainstream gas path surface, wherein the structure comprises several first grooves and several second grooves with the several first grooves being parallel towards each other and the several second grooves being parallel towards each other, wherein a first groove of the several first grooves and a second groove of the several second grooves are arranged end-to-end to form a line, wherein the several first grooves and second grooves extend in the outer surface of the aerofoil from a leading edge to a trailing edge of the aerofoil and are oriented in at least two different directions with a deflection angle ($\alpha$) towards each other, wherein said deflection angle ($\alpha$) has a component in a span wise direction of the aerofoil.

15. The turbine assembly according to claim 14, wherein the deflection angle ($\alpha$) is up to 45°.

16. The turbine assembly according to claim 14, further comprising a cooling system for feeding the flow of the cooling medium to the outer surface.

17. The turbine assembly according to claim 16, further comprising a rim seal which forms an opening of the cooling system.

18. The turbine assembly according to claim 16, wherein the first groove and/or the second groove are arranged in an axial direction and in a stream wise direction downstream of a film cooling injection point of the cooling system.

19. The turbine assembly according to claim 16, wherein the cooling system comprises a film cooling injection point to feed the flow of the cooling medium to the first groove and/or the second groove.

20. The turbine assembly according to claim 19, wherein the film cooling injection point is an opening, comprising a hole and/or a slot.

* * * * *